US006400094B2

(12) United States Patent
Mizobata

(10) Patent No.: US 6,400,094 B2
(45) Date of Patent: Jun. 4, 2002

(54) METHOD FOR DRIVING AC-TYPE PLASMA DISPLAY PANEL

(75) Inventor: Eishi Mizobata, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/832,932

(22) Filed: Apr. 12, 2001

(30) Foreign Application Priority Data

Apr. 12, 2000 (JP) ..... 2000-110936

(51) Int. Cl.[7] ..... G09G 3/10

(52) U.S. Cl. ..... 315/169.4; 315/169.1; 345/60; 345/55; 345/67; 345/76; 345/74

(58) Field of Search ..... 315/169.4, 169.1, 315/169.3; 345/60, 55, 63, 66, 67, 76, 77, 79

(56) References Cited

U.S. PATENT DOCUMENTS 5,943,031 A * 8/1999 Tokunaga et al. ..... 345/60
6,054,970 A * 4/2000 Hirakawa et al. ..... 345/60
6,195,072 B1 * 2/2001 Iwami et al. ..... 345/67
6,320,313 B1 * 11/2001 Yoo et al. ..... 313/582

FOREIGN PATENT DOCUMENTS

JP A 9-81073 3/1997

OTHER PUBLICATIONS

H. Hirakawa et al., "Cell Structure and Driving Method of a 25–In. (64–cm) Diagonal High–Resolution Color ac Plasma Display," *SID 98 Digest*, pp. 279–282.

* cited by examiner

*Primary Examiner*—David H. Vu
*Assistant Examiner*—Tuyet T. Vo
(74) *Attorney, Agent, or Firm*—Young & Thompson

(57) ABSTRACT

A method for driving a plasma display panel is provided which is capable of making stable a discharge occurring when sustaining discharge starts and, when same gray shades are displayed, the discharge can be started with exactly same timing to perform the display of same gray shades. In the method, voltages of a scanning electrode and a common electrode during a sustaining period are set so that the discharge occurring with timing when the sustaining discharge starts is an opposite discharge which occurs between the scanning electrode and a data electrode and the timing when the sustaining discharge starts is decided based on a potential difference between electrodes placed opposite to each other.

28 Claims, 10 Drawing Sheets

METHOD FOR DRIVING AC-TYPE PLASMA DISPLAY PANEL

BACKGROUND OF THE INVENTION

1. Field of the Invention

The present invention relates to a method for driving an AC (alternating current) type plasma display panel and more particularly to the method for driving the AC-type plasma display panel which is effective in driving a scanning/sustaining separation three-electrode AC-type plasma display panel.

The present application claims priority of Japanese Patent Application No.2000-110936 filed on Apr. 12, 2000, which is hereby incorporated by reference.

2. Description of the Related Art

Generally, a plasma display panel (hereinafter, referred to as a PDP) incorporates many features in that it can be made thin, it can comparatively easily display a large screen, it can provide a wide-range viewing angle, it can provide a high response speed or a like. Therefore, in recent years, it is used for a wall-mounted television, public display plate or a like in a form of a flat display device. The PDP can be classified, by operation mode, into two groups; one being a DC (direct current)-type PDP adapted to be operated with its electrode being exposed to discharge space (that is, to discharge gas) and in a direct current discharging condition and another being an AC-type PDP adapted to be operated with its electrode coated with dielectric layers and without its electrode being directly exposed to discharging gas and in an alternating current discharging condition. In the DC-type PDP, discharge occurs while a voltage is being applied. In the AC-type PDP, discharge is sustained by changing a polarity of a voltage to be applied. Moreover, in the AC-type PDP, e number of electrodes contained in one cell is two or three.

Configurations and driving method of a conventional three-electrode AC-type PDP are described below. FIG. 7 is a cross-sectional view of one example of a cell used for a conventional PDP. The conventional three-electrode AC-type PDP includes a front substrate 20 and a rear substrate 21 both of which are placed opposite to each other, a plurality of scanning electrodes 22 each being disposed between the front substrate 20 and the rear substrate 21, a plurality of common electrodes 23 and a plurality of data electrodes 29 and display cells (described later in FIG. 8) each being disposed at each of intersections of each of the scanning electrodes 22 and each of the common electrodes 23 and each of the data electrodes 29. As the front substrate 20, a glass substrate or a like is used. Each of the scanning electrodes 22 and each of the common electrodes 23 are placed at a specified interval. On these scanning electrodes 22 and common electrodes 23 is formed a transparent dielectric layer 24. On the transparent dielectric layer 24 is formed a protecting layer 25 made up of MgO (Magnesium oxide) or a like adapted to protect the transparent dielectric layer 24 from discharging. On the other hand, as the rear substrate 21, a glass substrate or a like is used. Each of the data electrodes 29 is so mounted as to be orthogonal to each of the scanning electrodes 22 and to each of the common electrodes 23. On the data electrodes 29 is formed a white dielectric layer 28. On the white dielectric layer 28 is formed a phosphor layer 27. Between front substrate 20 and rear substrate 21 is placed a partition wall (not shown) at a specified interval in parallel to a face of paper in which FIG. 7 is shown. The partition wall is used to secure discharge space 26 and to demarcate pixels. The discharge space 26 is filled, in a sealed manner, with mixed gas such as He (Helium), Ne (Neon), Xe (Xenon) or a like, as discharge gas to be used for discharge. The conventional three-electrode AC-type PDP having such configurations as described above is disclosed in SID (Society for Information Display) 98 DIGEST (P279–281, May, 1998).

FIG. 8 is a plan view of the conventional three-electrode AC-type PDP. As shown in FIG. 8, at each of intersections of each electrode Si (i=1 to m) making up the scanning electrodes 22 and each electrode Ci (i=1 to m) making up the common electrode 23 and each electrode Dj (1 to n) making up the data electrode 29, each of display cells 31 is disposed. These display cells 31 are placed in a matrix form.

Next, a conventional method for driving a PDP will be described below. As the method for driving the PDP, a scanning/substaining separation method (ADS method) in which a scanning period and a sustaining period are separated is in the present mainstream. However, this method requires a plurality of sub-fields (SF) for displaying a gray shade and also requires the scanning period for each of the SFs. Therefore, if the number of gray scales or the number of scanning lines is increased, the scanning period forms an increasing proportion of one field and, as a result, the sustaining period forms a decreasing proportion of the one field, causing low luminance in display. To solve this problem, an alternative method for driving the PDP by which the gray shade can be displayed by one time scanning without using such SFs is proposed. The method of this type for driving the PDP is disclosed, for example, in Japanese Patent Application Laid-open No. Hei 9-81073.

The scanning/sustaining separation method will be described. FIG. 6 is a diagram showing waveforms explaining driving operations of the conventional three-electrode AC-type PDP. One field 1 is made up of three periods including a preliminary discharge period 2, a scanning period 3 and a sustaining period 4.

First, the preliminary discharge period 2 will be described. A preliminary discharge pulse 5 with positive polarity is applied to the common electrode 23 and a preliminary discharge pulse 6 with negative polarity is applied to the scanning electrode 22. This enables resetting of irregularity caused by light emitting conditions in a pre-field period, in a state in which wall charges occur at a final stage of a pre-SF and enables initialization and, at a same time, this causes all pixels to be forcedly discharged, thus providing a priming effect which induces subsequent writing discharge to occur at a lower voltage. Since this preliminary discharge pulse 5 causes all pixels to be discharged, a voltage of the preliminary discharge pulse 5 has to be higher than those of a scanning pulse and sustaining pulse.

Moreover, though, in the example shown in FIG. 6, both the preliminary discharge pulses 5 and 6 are applied once with same timing, in some cases, two kinds of pulses each having a different role are applied, that is, a priming pulse to cause all pixels to be discharged and priming effects to be implemented is applied after a sustainment extinguishing pulse to cause the state of the pre-field to be reset has been applied. At this point, in some cases, a different sustainment extinguishing pulse is applied not only once but also two or more numbers of times.

Furthermore, though, in the example shown in FIG. 6, to extinguish the wall charge produced by the preliminary discharge, a self-extinguishing process by using a fall of each of the preliminary discharge pulses 5 and 6 is employed, in some cases, a preliminary discharge extinguishing pulse is applied to extinguish these wall charges separately. In some cases, the preliminary discharge extinguishing pulse is also applied not only once but also two or more numbers of times.

Moreover, in some cases, these pulses are applied to other electrodes. In any case, the wall charge on the dielectric layer produced by the preliminary discharge is extinguished or is controlled to be proper in quantity.

Next, the scanning period 3 is described below. During the scanning period 3, the scanning pulse 8 is applied sequentially to each of electrodes (S1 to Sm) making up the scanning electrode 22. At the same time when the scanning pulse 8 is applied, a data pulse 9 is applied, in a manner so as to correspond to a display pattern, to each of electrodes (D1 to Dm) making up the data electrode 29. The data pulse 9 changes a pulse voltage in a manner depending on gray scale to be displayed. In the case of a gray scale with low luminance, the pulse voltage is set to a low level and, then, the voltage is boosted as luminance becomes higher. When application of the scanning pulse 8 is completed, a wall charge being almost equivalent to a potential difference between the scanning pulse 8 and the data pulse 9 is accumulated by writing discharge. Therefore, a large amount of the wall charge is accumulated in a pixel into which a signal with high luminance has been input and a small amount of the wall charge is accumulated in the pixel into which a signal with low luminance has been input. A scanning base voltage 7 being applied to the scanning electrode 22 during the scanning period is applied to prevent erroneous discharging that may occur, after the writing discharge, between the scanning electrode 22 and the common electrode 23 of a pixel being adjacent to the scanning electrode 22 (that is, between non-discharging gaps).

After the scanning pulse 8 has been applied to all lines, a sustaining period 4 starts. Each of the sustaining pulses 10 and 11 is applied alternately to all of the scanning electrodes 22 and all of the common electrodes 23. Voltages of the sustaining pulses 10 and 11 are increased in stages during the sustaining period. As a result, potential difference between the scanning electrode 22 and the common electrode 23 increases as their polarities are reversed. However, this voltage is set to a level at which discharge does not occur. Therefore, since an amount of the wall charge is small in a pixel in which writing discharge has not occurred, even when the sustaining pulses 10 and 11 are applied, no discharge occurs.

On the other hand, in the pixel in which the writing discharge occurs, the wall charge is accumulated in a manner to correspond to a gray shade. During the sustaining period 4, a voltage resulting from superposition of a voltage produced by the wall charge accumulated in the scanning electrode 22 by the writing discharge on the potential difference between the sustaining pulses 10 and 11 is applied between the scanning electrode 22 and the common electrode 23. Since the sustaining pulse voltage is increased in stages, when it exceeds a start voltage for surface discharge at some point in time, the surface discharge occurs between the scanning electrode 22 and the common electrode 23. At this time, since a data base voltage 12 is applied to the data electrode 29, no opposite discharge occurs. The "opposite discharge" here refers to the discharge which occurs between electrodes placed opposite to each other.

Once the surface discharge occurs, a large amount of the wall charge with reverse polarity is accumulated in the scanning electrode 22 and the common electrode 23. The accumulated wall charge, since the subsequent sustaining pulse voltage with reverse polarity is superposed on the wall charge, produces a large potential difference, thus causing the surface discharge with reverse polarity to occur again and a large amount of the wall charge with reverse polarity to be again accumulated. Thus, once the surface discharge occurs, every time the polarity of the sustaining pulse is reversed, the surface discharge is repeated until the sustaining period 4 ends.

A timing of a start of the surface discharge changes depending on an amount of the wall charge accumulated by the writing discharge. That is, if the amount of the wall charge is small, the sustaining pulse with a high voltage is required and the surface discharge does not start until the sustaining pulse 11 with the high voltage produced at a later stage of the sustaining period 4 is applied, while, if the amount of the wall charge is large, the surface discharge starts when the sustaining pulse with a low voltage is applied. Thus, by changing a period while light is emitted (that is, the period while discharge occurs) during the sustaining period 4 depending on the amount of the wall charge, the number of discharge is changed. Since the wall charge is produced by the writing discharge depending on the gray scale to be displayed, the number of the discharge can be controlled depending on the gray scale. Thus, the display of the gray scale is implemented by controlling number of times of the discharge.

As described above, while the writing discharge occurs, the wall charge is produced in the scanning electrode 22 by the opposite discharge. During the sustaining period 4, a voltage produced by the wall charge is superposed on the voltage of the sustaining pulse and, when the superposed voltage exceeds a start voltage for the discharge, the surface discharge occurs. In the case of the surface discharge, since the discharge starts in the proximity of a gap area for the surface discharge, that is, at an edge area where the scanning electrode 22 and the common electrode 23 are placed, in a same pixel, opposite to each other, the discharge cannot be stable because the discharge occurs at such a small end area on a line, thus causing flicker which occurs for a while even after the sustaining voltage has been boosted.

FIG. 9 is a diagram showing a relationship between a data pulse voltage and a start voltage for the discharge at which the surface discharge starts, obtained when driving the conventional three-electrode AC-type PDP by using the conventional driving waveforms as shown in FIG. 6. As shown in FIG. 9, the star voltage for the surface discharge varies linearly with the data pulse voltage. However, an unstable region 42 in which the discharge is unstable, causing flicker in display, exists between a discharging area 40 and a non-discharging area 41. In order to prevent such flicker from occurring during the sustaining period, as shown by a dashed line in FIG. 9, it is necessary to set both the data pulse voltage and sustaining pulse voltage at discrete values. At this point, the increased unstable region 42 causes a decrease in the number of gray scales that can be set.

Alternatively, it is possible to display gray scales even by using a method in which the sustaining pulse voltage is continuously increased. However, the increased unstable region 42 also causes flicker in displaying to be perceived by an eye, which is regarded as deterioration in displaying performance. When a low gray scale is displayed, in particular, a flickering period forms a large proportion in light-emitting periods, which is regarded as remarkable deterioration.

SUMMARY OF THE INVENTION

In view of the above, it is an object of the present invention to provide a method for driving an AC plasma display panel which makes it possible to reduce an unstable period of discharging, thus enabling an increased number of gray scales in display and reduction of flicker.

According to a first aspect of the present invention, there is provided a method for driving an AC-type plasma display panel wherein scanning electrodes and common electrodes are mounted on one of two insulating substrates placed opposite to each other and data electrodes are mounted on the other of the two insulating substrates in a manner so as to be orthogonal to both the scanning electrodes and the common electrodes, and pixels are formed at intersections of the scanning electrodes and the data electrodes in a matrix form, wherein operations are performed during a scanning period when a scanning pulse and a data pulse to cause writing discharge producing wall charges to occur so as to correspond to gray shades to be displayed, are applied sequentially to the scanning electrodes and the data electrodes and during a sustaining period when a sustaining pulse is applied alternately to each of the scanning electrodes and the common electrodes to cause sustaining discharge to occur which induces light emitting for displaying and wherein a number a the wall charge produced during the scanning period, the method including:

a step of controlling the number of times of the sustaining discharge by changing timing when the sustaining discharge starts according to amounts of the wall charge during the sustaining period, wherein the discharge occurring with timing when the sustaining discharge starts is an opposite discharge which occurs between the scanning electrodes and the data electrodes.

With the above configuration, a potential between the scanning electrode and the common electrode is set so that the discharge occurring when the sustaining discharge starts is the opposite discharge between the scanning electrode and the data electrode. Though a discharge between the scanning electrode and the common electrode is induced by the opposite discharge concomitantly, timing when the sustaining discharge starts is decided by a potential difference between the electrodes placed opposite to each other.

According to a second aspect of the present invention, there is provided a method for driving an AC-type plasma display panel wherein scanning electrodes and common electrodes are mounted on one of two insulating substrates placed opposite to each other and data electrodes are mounted on the other of the two insulating substrates in a manner so as to be orthogonal to both the scanning electrodes and the common electrodes, and pixels are formed at intersections of the scanning electrodes and the data electrodes in a matrix form, wherein operations are performed during a scanning period when a scanning pulse and a data pulse to cause writing discharge producing wall charges to occur so as to correspond to gray shades to be displayed, are applied sequentially to the scanning electrodes and the data electrodes and during a sustaining period when a sustaining pulse is applied alternately to each of the scanning electrodes and the common electrodes to cause sustaining discharge to occur which induces light emitting for displaying and wherein a number of times of the sustaining discharge is controlled by amounts of the wall charge produced during the scanning period, the method including:

a step of controlling the number of times of the sustaining discharge by changing timing when the sustaining discharge starts according to amounts of the wall charge during the sustaining period;

a step of controlling timing when the sustaining discharge starts according to a potential difference between each of the scanning electrodes and each of the data electrodes; and wherein surface discharge occurs at each of the scanning electrodes and each of the common electrodes after opposite discharge between each of the scanning electrodes and each of the data electrodes has occurred.

In the foregoing, a preferable mode is one wherein, when a gray level signal having maximum luminance is input, a potential difference between each of the scanning electrodes and each of the data electrodes is set so that sustaining discharge occurs between each of the scanning electrodes and each of the data electrodes by the sustaining pulse to be produced at an initial stage of the sustaining period.

Also, a preferable mode is one wherein the amount of the wall charge varies depending on a potential difference between the scanning pulse and the data pulse which are produced so as to correspond to luminance and gray levels.

Also, a preferable mode is one wherein, when a gray level signal having minimum luminance is input, a potential difference between each of the scanning electrodes and each of the data electrodes is set so that no discharge occurs between each of the scanning electrode and each of the data electrodes during the sustaining period.

Also, a preferable mode is one wherein a potential difference produced when the sustaining discharge starts increases gradually during the sustaining period.

Also, a preferable mode is one wherein a pulse whose polarity being opposite to that of the scanning pulse is applied when the sustaining discharge starts.

Also, a preferable mode is one wherein a voltage of the scanning pulse is negative.

Also, a preferable mode is one wherein a potential difference between each of the scanning electrodes and each of the data electrodes, which is produced when the sustaining discharge starts, is increased gradually, during the sustaining period, by changing a potential of the data electrode.

Also, a preferable mode is one wherein a potential difference between each of the scanning electrodes and each of the data electrodes, which is produced when the sustaining discharge starts, is increased gradually, during the sustaining period, by continuously changing a potential of the data electrode.

Also, a preferable mode is one wherein a potential difference between each of the scanning electrodes and each of the data electrodes, which is produced when the sustaining discharge starts, is increased gradually, during the sustaining period, by changing, in stages, a potential of the data electrode.

Also, a preferable mode is one wherein the potential of the data electrode to be changed in stages is made equal to the potential of the data pulse to be applied during the scanning period.

With the above configuration, the number of voltages to be set for a data driver can be reduced.

Also, a preferable mode is one wherein each of the preliminary discharge period, the scanning period and the sustaining period is defined as one sub-field and a plurality of the sub-fields make up one field to display one screen.

Also, a preferable mode is one wherein each of the sustaining periods making up the one sub-field within the one field has sustaining pulses in different number.

With the above configuration, the number of gray scales can be increased.

Furthermore, a preferable mode is one wherein all of the number of the sustaining pulses in each of the sub-fields in the one field during a period from a start of the sustaining discharge to an end of the sustaining period, is different in the one field.

With the above configurations, the display of gray shades is implemented by changing the timing when the sustaining discharge starts so as to correspond to the wall charges accumulated by writing discharge and the discharge occurring when the sustaining discharge is started can be made stable and, when same gray shades are displayed, the discharge can be started with the exactly same timing to perform the display of the same gray shades.

BRIEF DESCRIPTION OF THE DRAWINGS

The above and other objects, advantages and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

First Embodiment

Figure 1:
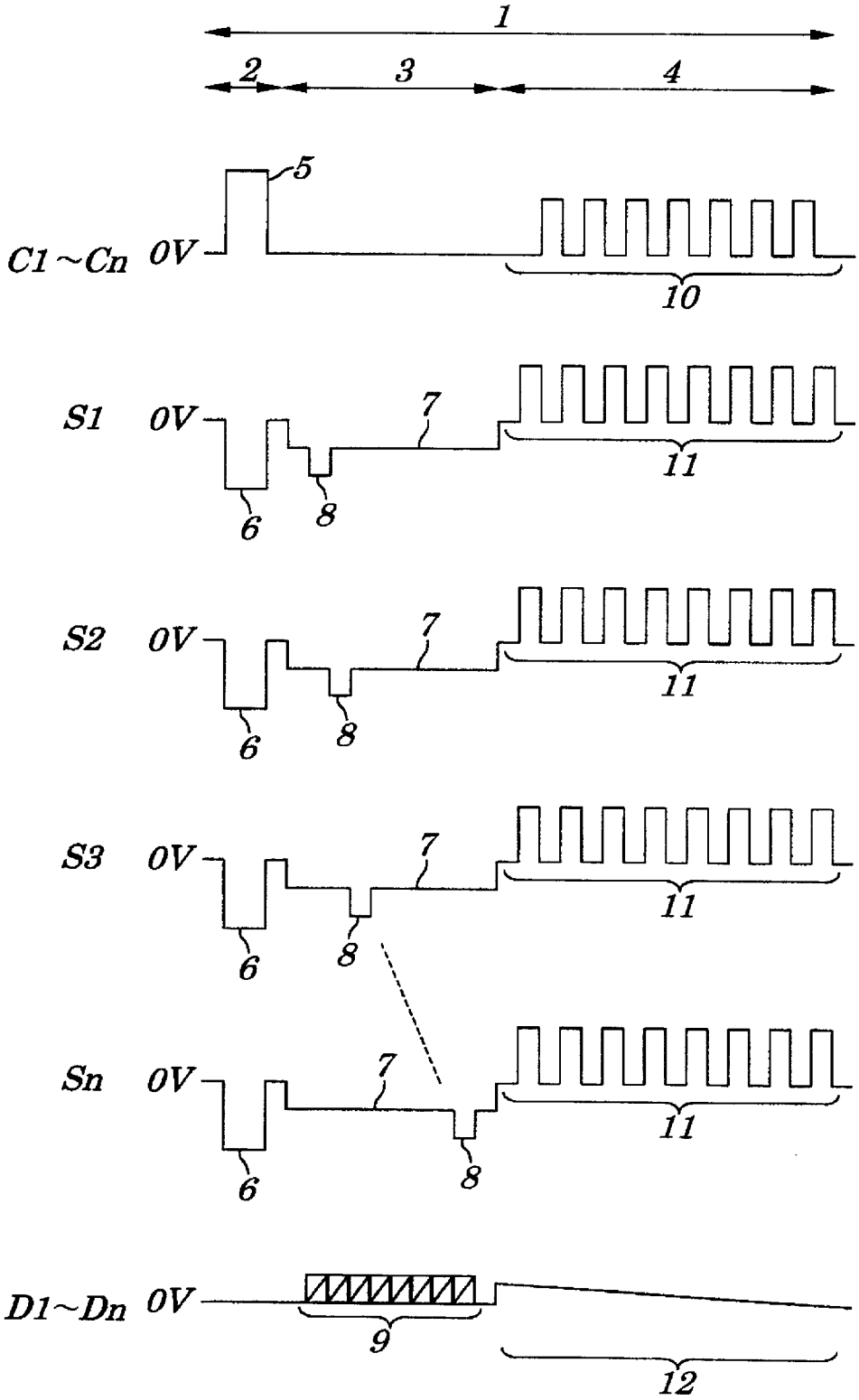
FIG. 1 is a diagram of waveforms explaining driving of a three-electrode AC-type PDP according to a first embodiment of the present invention.
Figure 7:
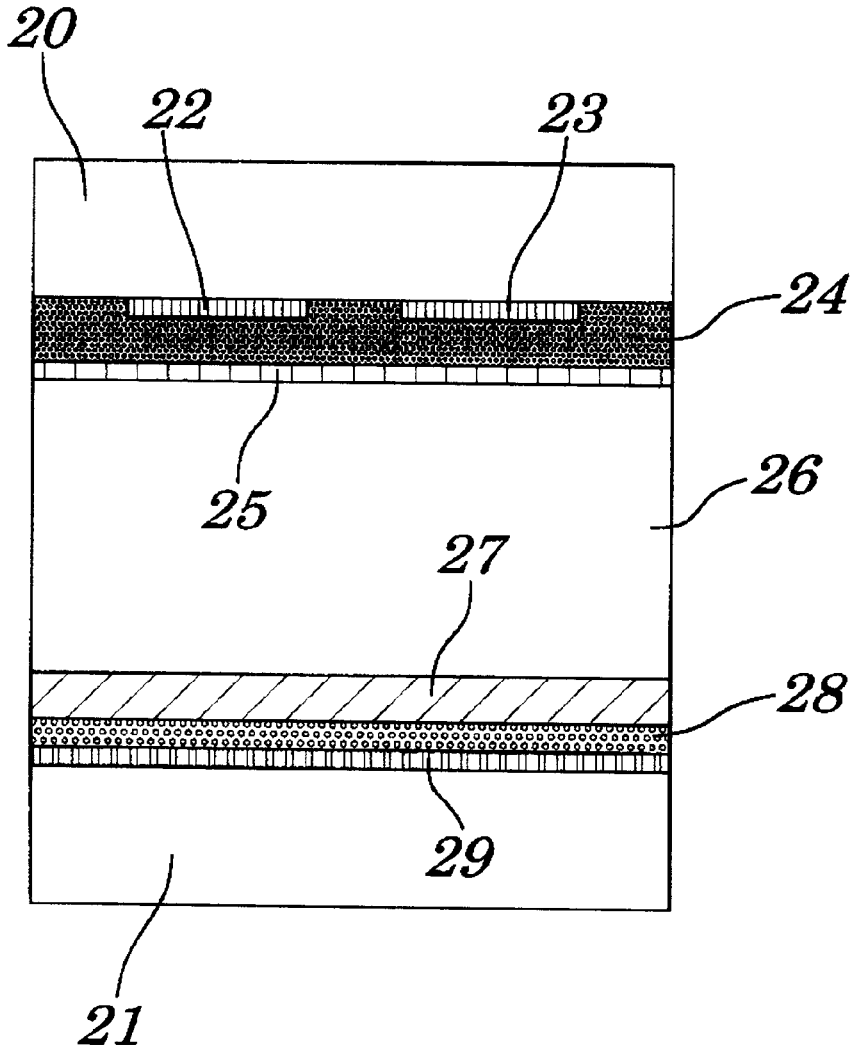
FIG. 7 (PRIOR ART)
FIG. 7 is a cross-sectional view of one example of a cell used for the conventional three-electrode AC-type PDP.
Figure 8:
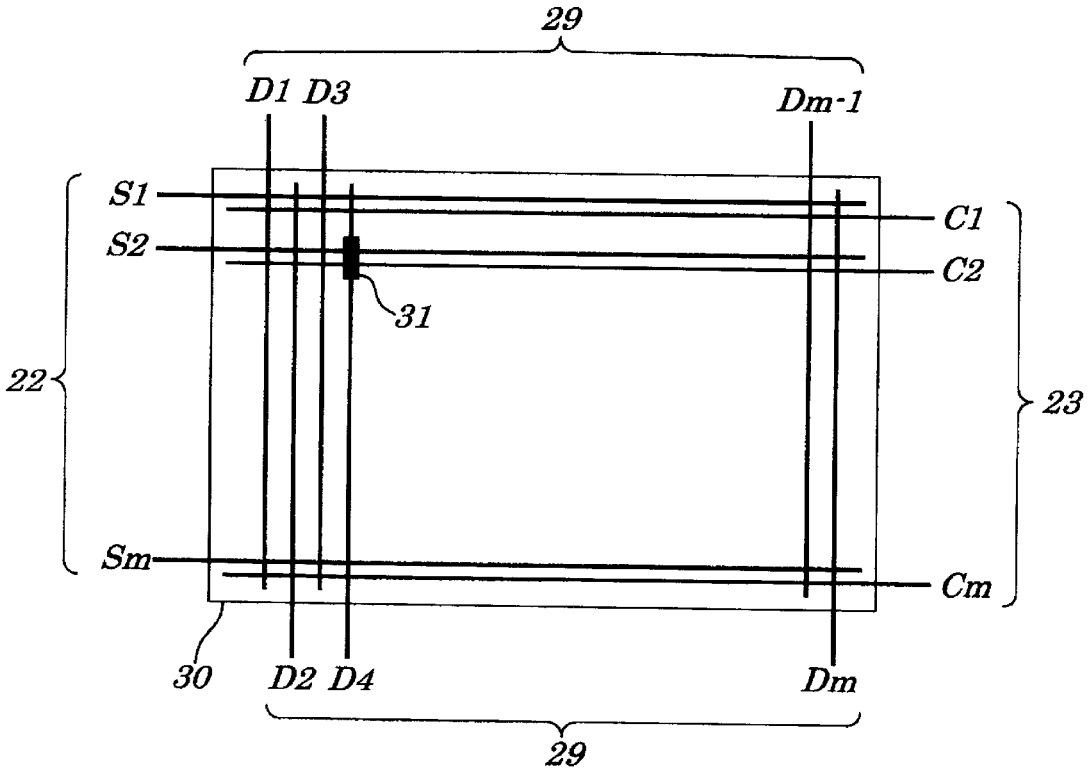
FIG.8 (PRIOR ART)
FIG. 8 is a plan view of the conventional three-electrode AC-type PDP.

FIG. 1 is a diagram of waveforms explaining driving of a three-electrode AC-type and scanning/sustaining separation-type PDP according to a first embodiment of the present invention. Configurations of the AC-type PDP and of its cells of the first embodiment are the same as those shown in FIGS. 7 and 8. In this embodiment, cell dimensions and discharge gas conditions are set so that a start voltage for an opposite discharge in which a scanning electrode 22 is used as a negative electrode is 165V, a start voltage for the opposite discharge in which the data electrode 29 is used as the negative electrode is 200V and a start voltage for a surface discharge is 210V. Specifically, a gap interval for the opposite discharge is set at 110 $\mu$m, a gap interval for a face discharge is set at 100 $\mu$m, a thickness of a transparent dielectric layer 24 is 30 $\mu$m, a thickness of a white dielectric layer 28 is 10 $\mu$m and a thickness of a phosphor layer 27 is about 20 $\mu$m. Discharge gas is composed of He and Ne in a ratio of 0.7:0.3 and Xe (3%). Gas pressure is 500 Torr.

Figure 6:
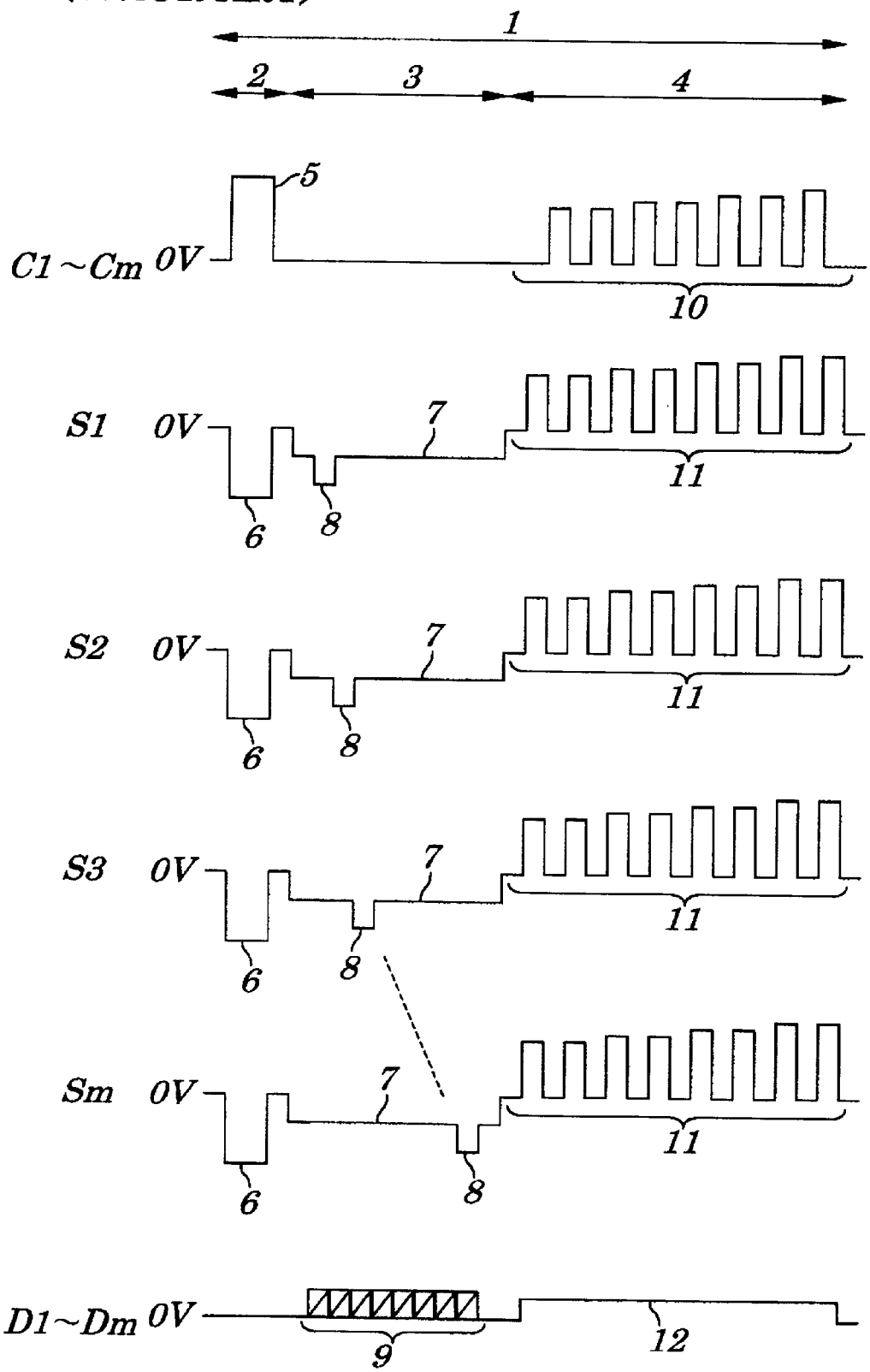
FIG. 6(PRIOR ART)
FIG. 6 is a diagram showing waveforms explaining driving operations of a conventional three-electrode AC-type PDP.

Preliminary discharge field 2 and scanning period 3 are the same as those in the conventional case shown in FIG. 6. A voltage of a preliminary discharge pulse with positive polarity is set at 200 V and a voltage of a preliminary discharge pulse with negative polarity is set at −200V. Pulse width of these pulses is set at 4 $\mu$sec to 6 sec. During the scanning period 3, a scanning base voltage 7 with a voltage of about 50V to 90V is being applied to the scanning electrode 22. A scanning pulse 8 with a voltage of about 180V is applied sequentially to the electrodes S1 to Sn. A width of the scanning pulse is set at 2.0 sec to 3.0 $\mu$sec. A data pulse 9 corresponding to an image signal is applied in synchronization with the scanning pulse 8. A voltage of the data pulse 9 is 0V to 70V and is 0V for a 0-th shade of gray (black) and 70V for a 7-th shade of gray (white) and the voltage from 0V to 70V is set in 10V steps so as to correspond to each of the 0-th to 7-th shades of gray so that eight shades of gray are displayed. After all the scanning pulses 8 have been applied, the sustaining period 4 starts. During the sustaining period 4, a sustaining pulse 10 with positive polarity is applied to the common electrode 23 and a sustaining pulse 11 with positive polarity is applied to the scanning electrode 22, alternatively. A voltage of these sustaining pulses 10 and 11 is set at 130V. As shown in FIG. 1, during the sustaining period 4, a voltage represented by a sustaining discharge start control signal 12 having a lamp-like waveform in which its voltage with positive polarity falls gradually is applied to the data electrode 29. The voltage of the sustaining discharge start control signal 12 is set so as to fall to 0V at a final stage.

Operations during the preliminary discharge period 2 are the same as those in the conventional case shown in FIG. 6 and descriptions of them are omitted therefore.

Subsequent to the preliminary discharge period 2, the scanning period 3 starts. During the sustaining period 4, the scanning pulse 8 is applied to each of the scanning lines and, with the timing of application of the scanning pulse 8, a data signal for one scanning line is applied, as the data pulse 9, to the data electrode 29. Since the data pulse voltage is set so as to correspond to each of the gray shades, a potential difference between the scanning electrode 22 and the data electrode 29 at a time of writing varies depending on the gray shade. Since the start voltage for the opposite discharge at this point is 165V, discharge does not occur in the 0-th shade of gray, however, in other gray shades, discharge occurs. Once the discharge occurs, wall charges being almost equivalent to the potential difference are accumulated. Therefore, an amount of the wall charge which varies depending on the shade of gray is accumulated.

After the scanning period 3 ends, the sustaining period 4 starts. If no writing discharge has occurred during the scanning period 3, no wall charge is accumulated on any electrode. In this case, during the sustaining period 4, since a maximum voltage applied to any electrode is up to 160V, the sustaining discharge does not occur.

Next, the writing discharge occurring during the scanning period 3 will be described below. In the case of display in a 1st shade of gray, at a time of writing discharge, the data pulse 9 with a voltage of 10V is applied and, as a result, the wall charge with a voltage of about +40V is accumulated on the scanning electrode 22 and the wall charge with a voltage of about −20V is accumulated on the data electrode 29.

Since a start voltage for the opposite discharge by using the data electrode 29 as the negative electrode, at a time when a potential difference between the scanning electrode 22 and data electrode 29, becomes 140V, the voltage exceeds 200V because the wall charge with a voltage of 60V (40V+20V) has been superposed on the potential difference, thus causing the opposite discharge to occur between the scanning electrode 22 and the data electrode 29. Since a sustaining pulse voltage is 160V, when the voltage of the sustaining discharge start control signal 12 becomes 20V (160V−140V), the opposite discharge between the scanning electrode 22 and the data electrode 29 occurs.

Similarly, in the case of the 7-th shade of gray, since the wall charge of 90 V (which is a result of addition of positive and negative voltages) is produced in the scanning electrode 22 and the data electrode 29, when the voltage of the sustaining discharge start control signal 12 becomes 50V (200V−90V), the opposite discharge occurs between the scanning electrode 22 and the data electrode 29. In the case of other gray scales, the timing of the occurrence of the opposite discharge is decided in a similar manner. In a gray shade for which a higher data pulse voltage is applied, the voltage of the sustaining discharge start control signal 12 becomes more higher, causing the opposite discharge to occur at earlier timing.

The opposite discharge, unlike the surface discharge occurring in a small range at an edge of the electrode, occurs between planar electrodes placed opposite to each other and, therefore, stable discharge is achieved.

Once the opposite discharge occurs, a large amount of the wall charge is accumulated on the scanning electrode 22. Moreover, immediately after the opposite discharge has occurred, a polarity of the potential difference between the scanning electrode 22 and common electrode 23 is reversed and the wall charge produced by the opposite discharge is superposed on the potential difference and, as a result, a voltage exceeding the surface discharge start voltage is applied. Since priming effects have appeared here in the opposite discharge occurred immediately before, a state in which the surface discharge easily occur is achieved, thus enabling the operation to proceed from the opposite discharge to the surface discharge in a stable manner. Once the surface discharge occurs, as in the case of the conventional sustaining discharge, thereafter, the surface discharge occurs every time the polarity of the sustaining pulse is reversed and the sustaining discharge continues until the end of the sustaining period 4.

Thus, timing of the start of the sustaining discharge can be controlled by the data pulse voltage. Since the number of times of the sustaining discharge is decided according to the timing of starting the sustaining discharge during the sustaining period, the number of times of the sustaining discharge can be controlled by the data pulse voltage and the display of the gray shades can be implemented.

Figure 9:
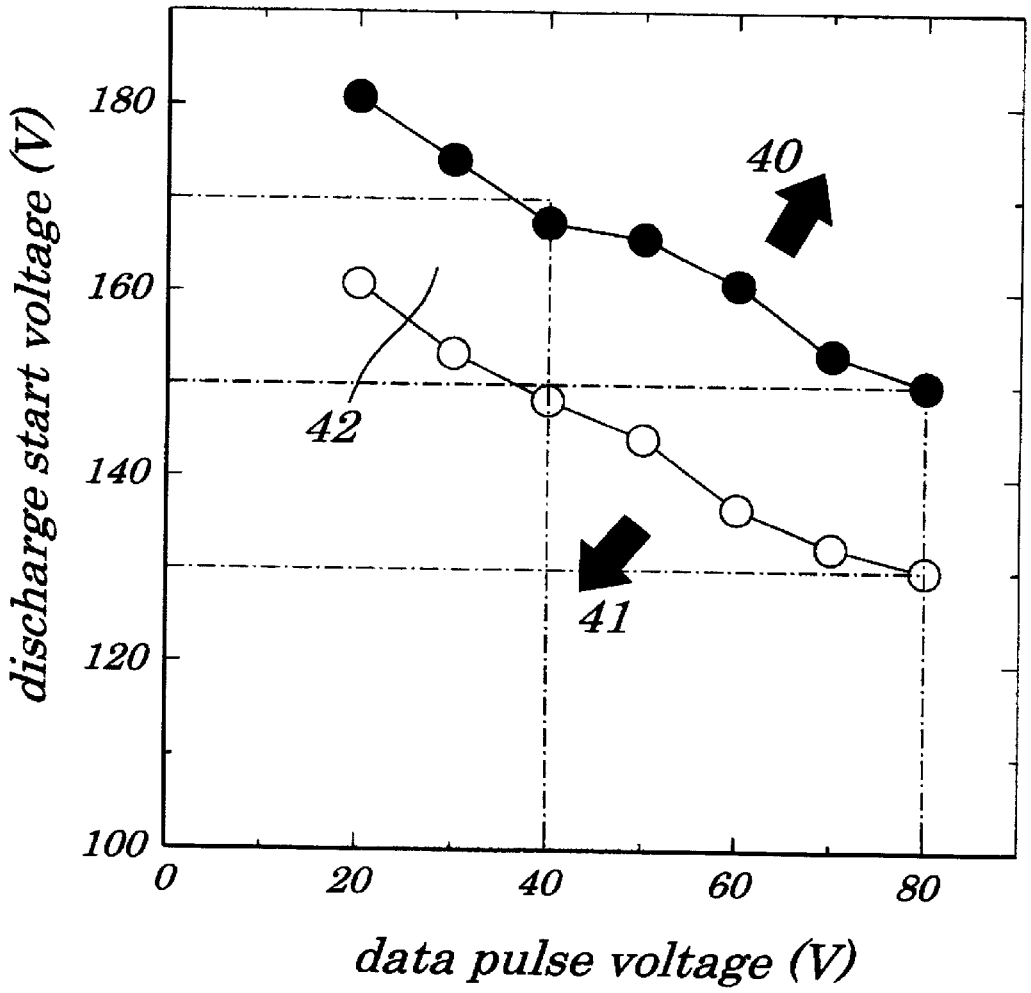
FIG.9 (PRIOR ART)
FIG. 9 is a diagram showing a relationship between a data pulse voltage and a start voltage for discharge obtained by a conventional method for driving the conventional three-electrode AC-type PDP.
Figure 10:
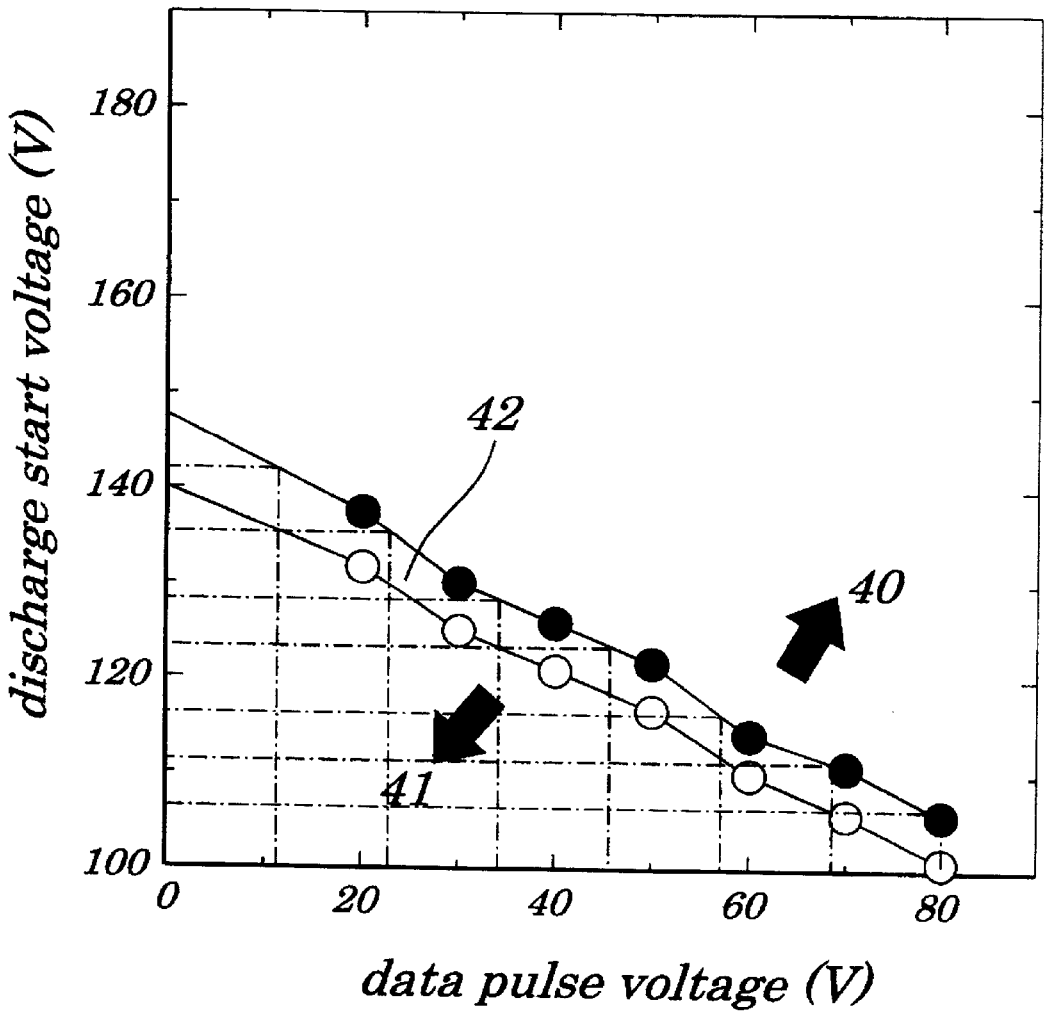
FIG. 10 is a diagram showing a relationship between a data pulse voltage and a start voltage for discharge obtained by a method for driving the three-electrode AC-type PDP according to embodiments of the present invention.

Moreover, FIG. 10 is a diagram showing a relationship between a data pulse voltage and a start voltage for discharge obtained by the method for driving the three-electrode AC-type PDP according to the first embodiment of the present invention. In FIG. 10, an area 40 is a discharging area, an area 41 is a non-discharging area and an area 42 is an unstable area. It is clear from FIG. 10 that the unstable area 42 is made smaller when compared with the case shown in FIG. 9. This enables exact display of gray shades without less flicker and the number of gray shades to be increased.

Second Embodiment

Figure 2:
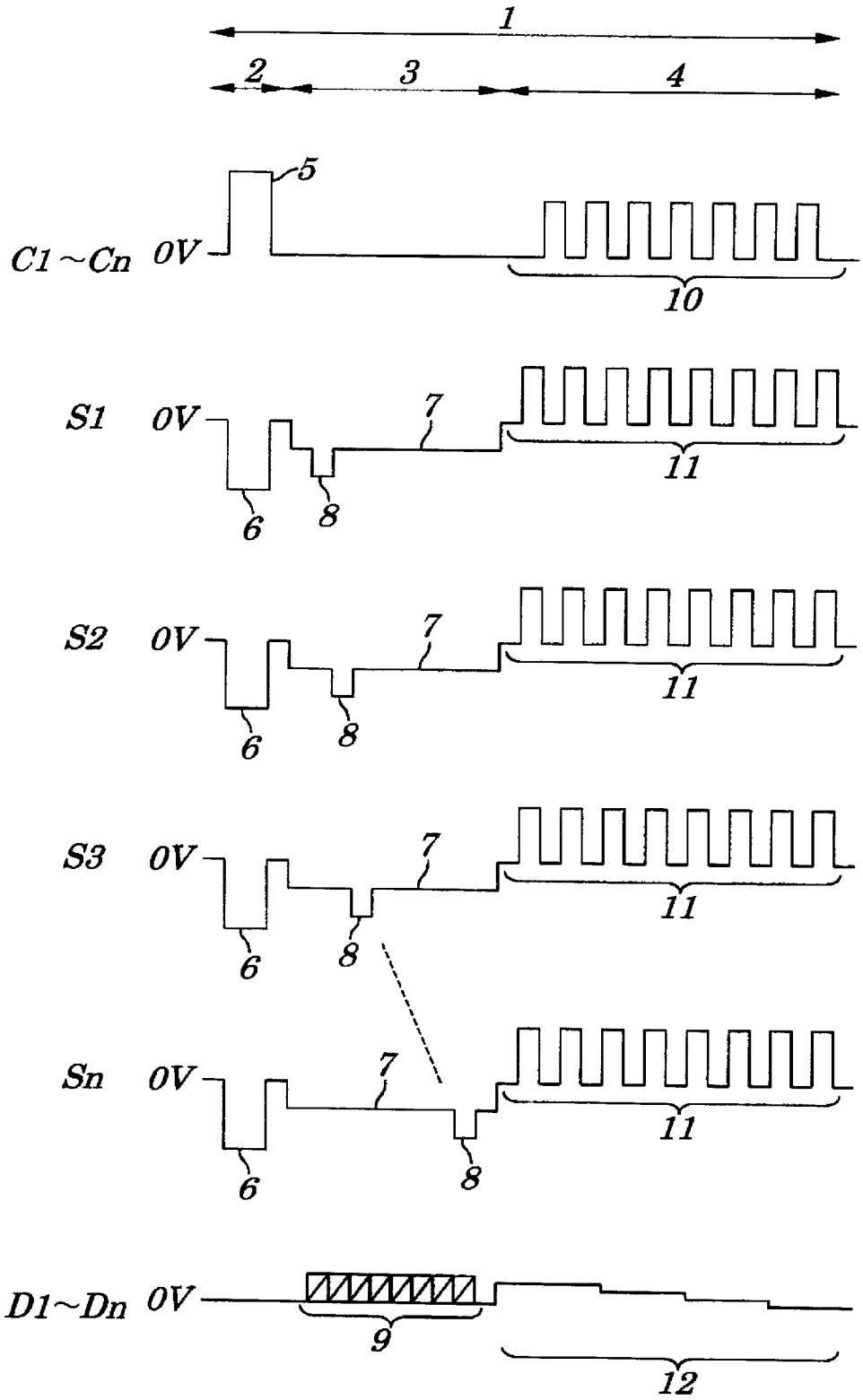
FIG. 2 is a diagram of waveforms explaining driving of a three-electrode AC-type PDP according to a second embodiment of the present invention.

FIG. 2 is a diagram of waveforms explaining driving of a three-electrode AC-type PDP according to a second embodiment of the present invention. Configurations of a panel and a cell of this embodiment are the same as those in the case of the first embodiment. Methods for driving the AC-type PDP of the second embodiment are also the same as those in the case of the first embodiment except that a voltage of sustaining discharge control signal 12 during a sustaining period 4 falls gradually and in stages and that the number of gray scales is four. In the second embodiment, the voltage of the sustaining discharge control signal 12 falls gradually in a four-stage manner. The voltages are 50V, 40V, 30V, and 0V in decreasing order. A voltage of a data pulse is 0V to 80V and is 0V for a 0-th shade of gray (black) and 70V for a 3-th shade of gray (white) and the voltage from 0V to 80V is set in 10V steps so as to correspond to each of the 0th to 3-th shades of gray so that four shades of gray can be displayed. In the case of the 0-th shade of gray (black), as in the case of the first embodiment, neither writing discharge nor sustaining discharge occurs. In the case of a 1st shade of gray, a data pulse 9 of 20V is applied and a wall charge of about 65V is produced. Therefore, when potential difference between a scanning electrode 22 and a data electrode 29 becomes not less than 135V (200V−65V), that is, when the voltage of the sustaining discharge start signal 12 becomes not more than 25V (160V−135V), opposite discharge occurs. That is, the sustaining discharge occurs only while the voltage of the sustaining discharge control signal 12 is 0V. Similarly, in the case of 2-nd, 3-rd, and 4th shades of gray, the wall charges of about 75V, about 85V, and about 95V, respectively, are produced and, therefore, when the voltage of the sustaining discharge start signal 12 becomes 30V, 40V, and 50V, the sustaining discharge starts to occur, respectively, and continues until the sustaining period 4 ends, thereby implementing display of four gray shades.

Third Embodiment

Figure 3:
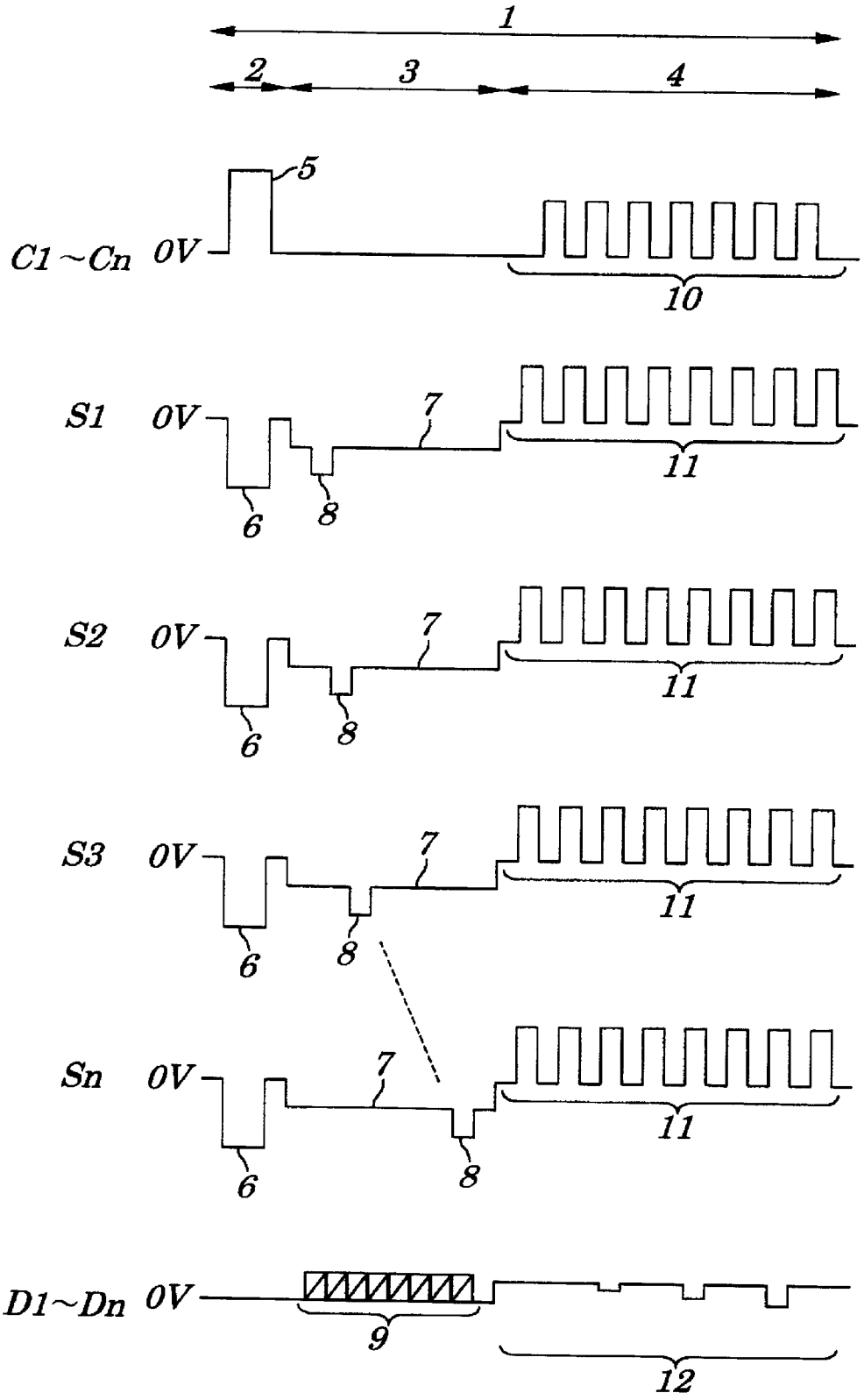
FIG. 3 is a diagram of waveforms explaining driving of a three-electrode AC-type PDP according to a third embodiment of the present invention.

FIG. 3 is a diagram of waveforms explaining driving of a three-electrode AC-type PDP according to a third embodiment of the present invention. Configurations of a panel and a cell of this embodiment are the same as those in the case of the second embodiment. Methods for driving the AC-type PDP of the third embodiment are also the same as those in the case of the second embodiment except that a sustaining discharge control signal 12 is set so that pulses having negative polarity are applied only when an opposite discharge occurs, so as to correspond to shades of gray, starts to occur. That is, in the third embodiment, during a sustaining period 4, a positive bias of 50V is applied to a data electrode 29 and the sustaining discharge control signal 12 is set so that an applied bias voltage value is changed to a negative pulse of 10V, 20V, and 50V only when the opposite discharge occurs. Therefore, a potential difference between the scanning electrode 22 and the data electrode 29 becomes 110V at the time of the start of the sustaining period 4 and thereafter 120V, 130V, and 160V at the time when the opposite discharge starts to occur, that is, at the time of an application of the negative pulse and, as a result, potential difference is the same as in the case of the second embodiment. Thus, as in the case of the second embodiment, the timing when sustaining discharge starts is made different for every gray shade, thereby implementing display of gray shades.

Fourth Embodiment

Figure 4:
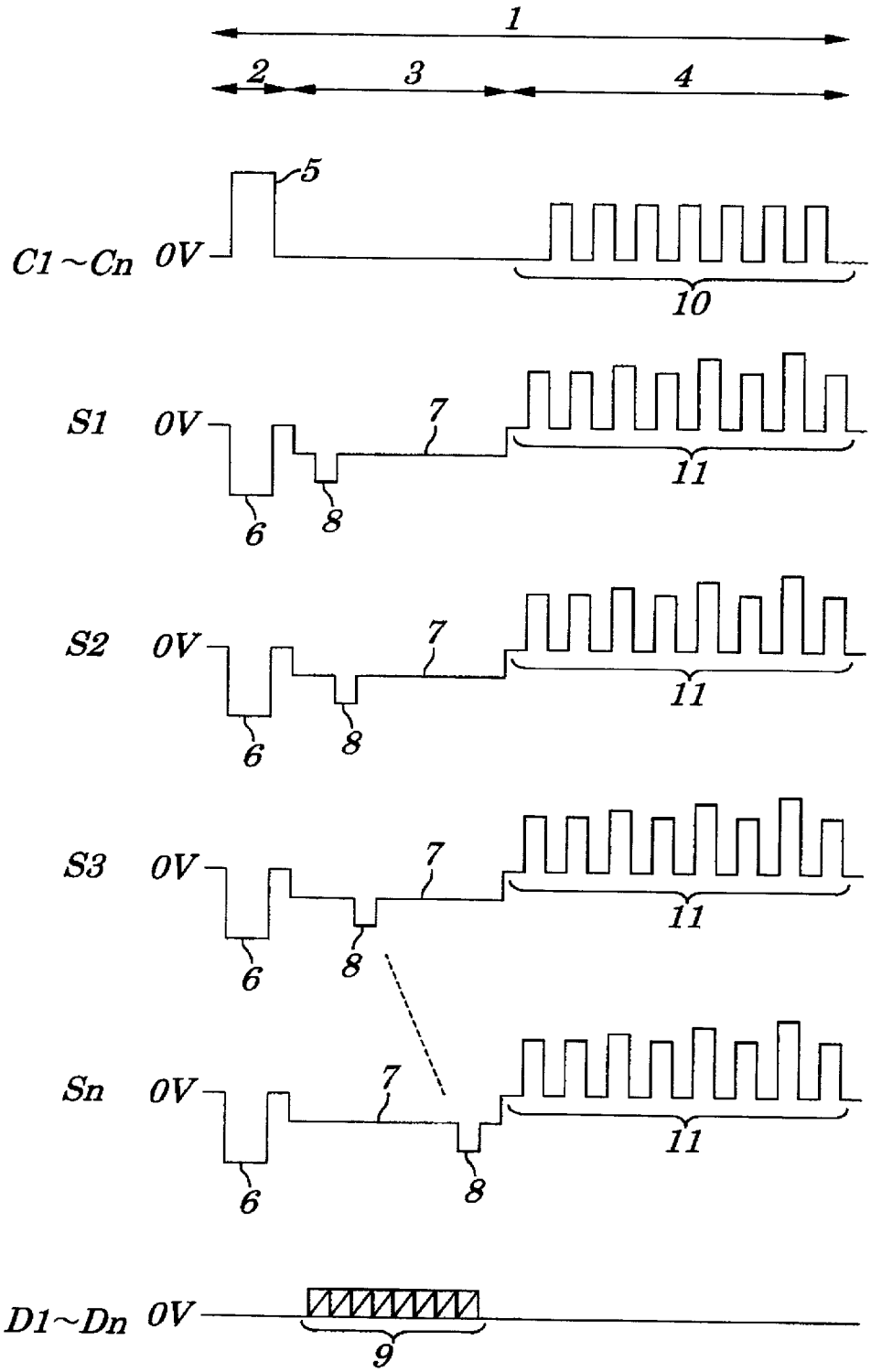
FIG. 4 is a diagram of waveforms explaining driving of a three-electrode AC-type PDP according to a fourth embodiment of the present invention.

FIG. 4 is a diagram of waveforms explaining driving of a three-electrode AC-type PDP according to a fourth embodiment of the present invention. Configurations of a panel and a cell and a preliminary discharge period 2 and a scanning period 3 of this embodiment are the same as those in the case of the third embodiment. Unlike in the case of the third embodiment in which a start timing of a sustaining discharge is decided by controlling a voltage of a sustaining discharge start control signal 12 to be applied to a data electrode 29, in the fourth embodiment, the start timing of the sustaining discharge for each gray scale is decided by changing a voltage of a sustaining pulse 11 to be applied to a scanning electrode 22. Both an initial voltage of a sustaining pulse 10 and an initial voltage of the sustaining pulse 11 are 110V. In this embodiment, as in the case of the third embodiment, voltages are set so that four shades of gray can be displayed. The voltages of the sustaining pulse 11 used to start the sustaining discharge for each shade of gray are 120V, 130V, and 160V. The voltage of the sustaining pulse 11 used except when sustaining discharge occurs is 110V. Thus, the display of shades of gray can be implemented as in the third embodiment.

Fifth Embodiment

Figure 5:
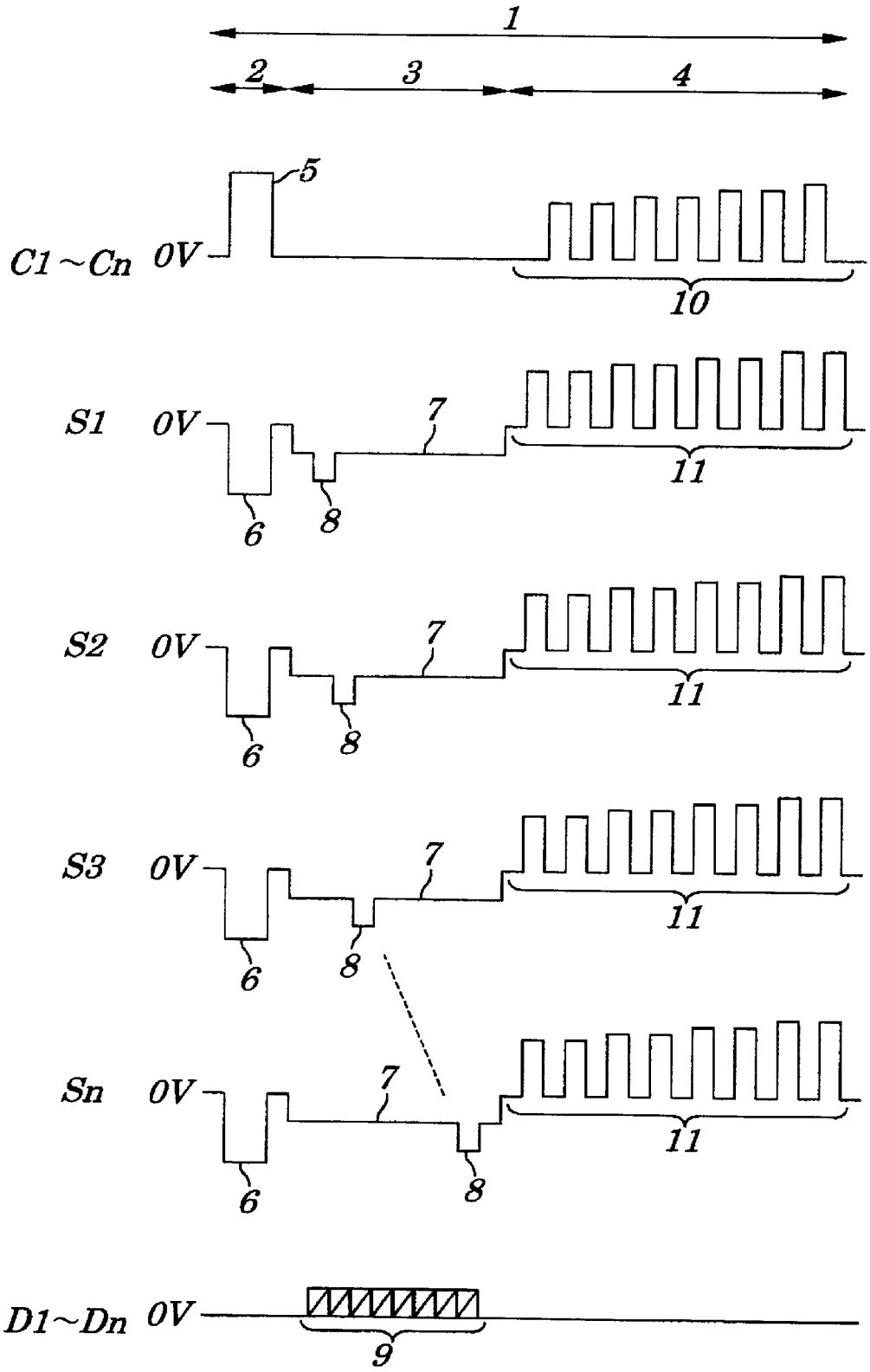
FIG. 5 is a diagram of waveforms explaining driving of a three-electrode AC-type PDP according to a fifth embodiment of the present invention.

FIG. 5 is a diagram of waveforms explaining driving of a three-electrode AC-type PDP according to a fifth embodiment of the present invention. Configurations of a panel and a cell and a preliminary discharge period 2 and a scanning period 3 of this embodiment are the same as those in the case of the third embodiment. Methods for driving the AC-type PDP of the fifth embodiment are also the same as those in the case of the second embodiment except that voltages of a sustaining pulse 11 are boosted in stages. The voltages of the sustaining pulse 11 used to start a sustaining discharge for each shade of gray is 110V as an initial voltage and thereafter 120V, 130V, and 160V. Thus, display of gray shades can be implemented as in the fourth embodiment.

Thus, according to embodiments of the present invention, the discharge occurring when the sustaining discharge is started can be made stable.

It is apparent that the present invention is not limited to the above embodiments but may be changed and modified without departing from the scope and spirit of the invention.

What is claimed is:

1. A method for driving an alternating current-type plasma display panel wherein scanning electrodes and common electrodes are mounted on one of two insulating substrates placed opposite to each other and data electrodes are mounted on the other of said two insulating substrates in a manner so as to be orthogonal to both said scanning electrodes and said common electrodes, and pixels are formed at intersections of said scanning electrodes and said data electrodes in a matrix form, wherein operations are performed during a scanning period when a scanning pulse and a data pulse to cause writing discharge producing wall charges to occur so as to correspond to gray shades to be displayed, are applied sequentially to said scanning electrodes and said data electrodes and during a sustaining period when a sustaining pulse is applied alternately to each of said scanning electrodes and each of said common electrodes to cause sustaining discharge to occur which induces light emitting for displaying, and wherein a number of times of said sustaining discharge is controlled by amounts of said wall charges produced during said scanning period, said method comprising:

a step of controlling the number of times of said sustaining discharge by changing timing when said sustaining discharge starts according to amounts of said wall charges during said sustaining period, wherein said discharge occurring with timing when said sustaining discharge starts is an opposite discharge which occurs between said scanning electrodes and said data electrodes.

2. The method for driving the alternating current-type plasma display panel according to claim 1, wherein, when a gray level signal having maximum luminance is input, a potential difference between each of said scanning electrodes and each of said data electrodes is set so that discharge occurs between each of said scanning electrodes and each of said data electrodes by said sustaining pulse to be produced at an initial stage of said sustaining period.

3. The method for driving the alternating current-type plasma display panel according to claim 1, wherein the amount of said wall charge varies depending on a potential difference between said scanning pulse and said data pulse which are produced so as to correspond to luminance and gray levels.

4. The method for driving the alternating current-type plasma display panel according to claim 1, wherein, when a gray level signal having minimum luminance is input, a potential difference between each of said scanning electrodes and each of said data electrodes is set so that no discharge occurs between each of said scanning electrodes and each of said data electrodes during said sustaining period.

5. The method for driving the alternating current-type plasma display panel according to claim 1, wherein a potential difference produced when said sustaining discharge starts increases gradually during said sustaining period.

6. The method for driving the alternating current-type plasma display panel according to claim 1, wherein a pulse whose polarity being opposite to that of said scanning pulse is applied when said sustaining discharge starts.

7. The method for driving the alternating current-type plasma display panel according to claim 6, wherein a voltage of said scanning pulse is negative.

8. The method for driving the alternating current-type plasma display panel according to claim 1, wherein a potential difference between each of said scanning electrodes and each of said data electrodes, which is produced when said sustaining discharge starts, is increased gradually, during said sustaining period, by changing a potential of said data electrode.

9. The method for driving the alternating current-type plasma display panel according to claim 8, wherein a potential difference between each of said scanning electrodes and each of said data electrodes, which is produced when said sustaining discharge starts, is increased gradually, during said sustaining period, by continuously changing a potential of said data electrode.

10. The method for driving the alternating current-type plasma display panel according to claim 8, wherein a potential difference between each of said scanning electrodes and each of said data electrodes, which is produced when said sustaining discharge starts, is increased gradually, during said sustaining period, by changing, in stages, said potential of said data electrode.

11. The method for driving the alternating current-type plasma display panel according to claim 10, wherein said potential of said data electrode to be changed in stages is made equal to said potential of said data pulse to be applied during said scanning period.

12. The method for driving the alternating current-type plasma display panel according to claim 1, wherein each of said preliminary discharge period, said scanning period, and said sustaining period is defined as one sub-field and a plurality of said sub-fields make up one field to display one screen.

13. The method for driving the alternating current-type plasma display panel according to claim 12, wherein each of said sustaining periods making up said one sub-field within said one field has sustaining pulses in different number.

14. The method for driving the alternating current-type plasma display panel according to claim 12, wherein all of the number of said sustaining pulses in each of said sub-fields in said one field during a period from a start of said sustaining discharge to an end of said sustaining period, is different in said one field.

15. A method for driving an alternating current-type plasma display panel wherein scanning electrodes and common electrodes are mounted on one of two insulating substrates placed opposite to each other and data electrodes are mounted on the other of said two insulating substrates in a manner so as to be orthogonal to both said scanning electrodes and said common electrodes, and pixels are formed at intersections of said scanning electrodes and said data electrodes in a matrix form, wherein operations are performed during a scanning period when a scanning pulse and a data pulse to cause writing discharge producing wall charges to occur so as to correspond to gray shades to be displayed, are applied sequentially to said scanning electrodes and said data electrodes and during a sustaining period when a sustaining pulse is applied alternately to each of said scanning electrodes and said common electrodes to cause sustaining discharge to occur which induces light emitting for displaying and wherein a number of times of said sustaining discharge is controlled by amounts of said wall charges produced during said scanning period, said method comprising:

a step of controlling the number of times of said sustaining discharge by changing timing when said sustaining discharge starts according to amounts of said wall charge during said sustaining period;

a step of controlling said timing when said sustaining discharge starts according to a potential difference between each of said scanning electrodes and each of said data electrodes; and wherein surface discharge occurs at each of said scanning electrodes and each of said common electrodes after opposite discharge between each of said scanning electrodes and each of said data electrodes has occurred.

16. The method for driving the alternating current-type plasma display panel according to claim 15, wherein, when a gray level signal having maximum luminance is input, a potential difference between each of said scanning electrodes and each of said data electrodes is set so that discharge occurs between each of said scanning electrodes and each of said data electrodes by said sustaining pulse to be produced at an initial stage of said sustaining period.

17. The method for driving the alternating current-type plasma display panel according to claim 15, wherein the amount of said wall charge varies depending on a potential difference between said scanning pulse and said data pulse which are produced so as to correspond to luminance and gray levels.

18. The method for driving the alternating current-type plasma display panel according to claim 15, wherein, when a gray level signal having minimum luminance is input, a potential difference between each of said scanning electrodes and each of said data electrodes is set so that no discharge occurs between each of said scanning electrodes and each of said data electrodes during said sustaining period.

19. The method for driving the alternating current-type plasma display panel according to claim 15, wherein a potential difference produced when said sustaining discharge starts increases gradually during said sustaining period.

20. The method for driving the alternating current-type plasma display panel according to claim 15, wherein a potential difference between each of said scanning electrodes and each of said data electrodes, which is produced when said sustaining discharge starts, is increased gradually, during said sustaining period, by changing a potential of said data electrode.

21. The method for driving the alternating current-type plasma display panel according to claim 20, wherein a potential difference between each of said scanning electrodes and each of said data electrodes, which is produced when said sustaining discharge starts, is increased gradually, during said sustaining period, by continuously changing a potential of said data electrode.

22. The method for driving the alternating current-type plasma display panel according to claim 15, wherein a pulse whose polarity being opposite to that of said scanning pulse is applied when said sustaining discharge starts.

23. The method for driving the alternating current-type plasma display panel according to claim 22, wherein a voltage of said scanning pulse is negative.

24. The method for driving the alternating current-type plasma display panel according to claim 20, wherein a potential difference between each of said scanning electrodes and each of said data electrodes, which is produced when said sustaining discharge starts, is increased gradually, during said sustaining period, by changing, in stages, said potential of said data electrode.

25. The method for driving the alternating current-type plasma display panel according to claim 24, wherein said potential of said data electrode to be changed in stages is made equal to said potential of said data pulse to be applied during said scanning period.

26. The method for driving the alternating current-type plasma display panel according to claim 15, wherein each of said preliminary discharge period, said scanning period, and said sustaining period is defined as one sub-field and a plurality of said sub-fields make up one field to display one screen.

27. The method for driving the alternating current-type plasma display panel according to claim 26, wherein each of said sustaining periods making up said one sub-field within said one field has sustaining pulses in different number.

28. The method for driving the alternating current-type plasma display panel according to claim 26, wherein all of the number of said sustaining pulses in each of said sub-fields in said one field during a period from a start of said sustaining discharge to an end of said sustaining period, is different in said one field.

* * * * *